US006345464B1

(12) United States Patent
Kim et al.

(10) Patent No.: US 6,345,464 B1
(45) Date of Patent: Feb. 12, 2002

(54) FIREARMS WITH TARGET ILLUMINATORS, ELECTRIC SWITCHING DEVICES AND BATTERY POWER SOURCES

(75) Inventors: Paul Youngcho Kim, Westminster; John Wallace Matthews, Newport Beach, both of CA (US)

(73) Assignee: Surefire, LLC, Fountain Valley, CA (US)

( * ) Notice: Subject to any disclaimer, the term of this patent is extended or adjusted under 35 U.S.C. 154(b) by 0 days.

(21) Appl. No.: 09/229,915

(22) Filed: Jan. 13, 1999

(51) Int. Cl.[7] ..... F41G 1/34; F41G 1/35

(52) U.S. Cl. ..... 42/114; 362/109; 200/518; 200/552; 429/99

(58) Field of Search ..... 42/103; 362/110, 362/114; 200/518, 520, 529, 298, 552, 336, 564, 568, 569, 572–574; 429/96, 99, 100, 123, 159; 206/703, 704, 705

(56) References Cited

U.S. PATENT DOCUMENTS

| | | | | | |
|---|---|---|---|---|---|
| 504,523 | A | * | 9/1893 | Gartside et al. | 200/552 |
| 766,047 | A | * | 7/1904 | Lewis et al. | 200/552 |
| 1,047,245 | A | * | 12/1912 | Knauff | 200/552 |
| 1,102,967 | A | * | 7/1914 | Thomas | 200/552 |
| 1,206,734 | A | * | 11/1916 | Spalding | 200/552 |
| 1,424,404 | A | * | 8/1922 | Hartman | 200/552 |
| 1,579,671 | A | * | 4/1926 | Staats-oels | 362/110 |
| 1,604,872 | A | * | 10/1926 | Baird | 429/99 |
| 1,654,145 | A | * | 12/1927 | Schulte | 429/159 |
| 1,865,127 | A | * | 6/1932 | McKeen | 362/110 |
| 1,915,575 | A | * | 6/1933 | Koretzky et al. | 429/159 |

(List continued on next page.)

FOREIGN PATENT DOCUMENTS

| | | | | |
|---|---|---|---|---|
| GB | 500841 | * | 2/1939 | 42/103 |
| GB | 2032074 | * | 4/1980 | |

OTHER PUBLICATIONS

Brochure of Extended Range Flashlights with drawing of precision focused lamp assembly, by Laser Products Jan. 1, 1996.

*Primary Examiner*—Darren W. Ark

(57) ABSTRACT

Apparatus for firing projectiles at targets and for illuminating such targets include a projectile-firing elongate weapon having a fore-end structure and a target illuminator on that fore-end structure in a first quadrant between a vertical plane and a horizontal plane longitudinally through such elongate weapon in a firing position of that weapon. Additionally or alternatively, a target illuminator may include a housing in one piece with part of the fore-end structure. An electric lamp assembly for target illuminators, flashlights or other light sources has a support structure, a bezel structure on that support structure, and a shock-absorbed reflector structure inside that bezel structure. Such shock-absorbed reflector structure includes a reflector having a focal point, a first shock absorber between that reflector and the support structure and a second shock absorber between the bezel structure and that reflector. An electric light source has a luminous portion maintained on the focal point in the reflector by corresponding transverse and longitudinal luminous portion positioners at the light source and the shock absorbed reflector. An electric battery is composed of individually jacketed battery elements and a battery elements carrier of one or more compartments into which such battery elements are individually insertable side by side with all like terminals of such battery elements being on the same side in the or each compartment. A rotary switch has a self-contained electric ON/OFF switch having a projecting actuator, an angularly moveable actuator knob separate from that self-contained electric ON/OFF switch and projecting actuator, and a force-transmitting coupling from such angularly moveable actuator knob to the actuator of the electric ON/OFF switch. A rocker switch has a bistable rocker device including a pair of toggles and a pivoted rocker arm between that pair of toggles alterable between a stable OFF position and an alternative stable ON position.

54 Claims, 5 Drawing Sheets

U.S. PATENT DOCUMENTS 1,937,046 A * 11/1933 Schulte et al. ..... 429/159
1,950,835 A * 3/1934 Zajac ..... 362/114
2,137,230 A * 11/1938 Arden ..... 429/99
2,209,524 A * 7/1940 Key ..... 362/110
2,209,702 A * 7/1940 Meginniss ..... 200/568
2,236,736 A 4/1941 Scott ..... 362/110
2,484,424 A * 10/1949 Rosing ..... 200/552
2,513,950 A * 7/1950 Mares ..... 200/568
2,523,786 A * 9/1950 Soreng ..... 200/552
2,546,242 A * 3/1951 Stinson ..... 42/103
2,597,565 A * 5/1952 Chandler et al. ..... 362/110
2,639,356 A * 5/1953 Savage ..... 200/336
2,657,303 A * 10/1953 Dickens ..... 362/110
2,763,739 A * 9/1956 Forstrom et al. ..... 200/569
2,912,566 A * 11/1959 Cornett ..... 362/110
2,983,778 A * 5/1961 Munse ..... 429/99
3,075,396 A * 1/1963 Smith ..... 200/336
3,086,090 A * 4/1963 Carroll ..... 200/298
3,359,383 A * 12/1967 Cryer ..... 200/565
3,525,828 A * 8/1970 Eckhart et al. ..... 200/336
3,621,157 A * 11/1971 Schwab ..... 200/574
3,739,167 A * 6/1973 Avery ..... 362/110
3,743,915 A * 7/1973 Struck ..... 200/564
3,840,734 A * 10/1974 Oram ..... 362/267
3,992,225 A * 11/1976 Sykes ..... 429/99
4,021,954 A 5/1977 Crawford ..... 42/101
4,123,598 A * 10/1978 Hammel ..... 429/99
4,161,568 A * 7/1979 Lund ..... 429/99
4,313,272 A 2/1982 Matthews ..... 42/103
4,348,716 A 9/1982 Storm et al. ..... 362/188
4,383,007 A * 5/1983 Murphy ..... 429/96
4,533,980 A * 8/1985 Hayes ..... 362/110
4,607,207 A * 8/1986 Bruneau ..... 429/99
4,777,754 A 10/1988 Reynolds, Jr. ..... 42/103
4,856,218 A 8/1989 Reynolds, Jr. ..... 42/103
4,882,942 A * 11/1989 Hamilton ..... 200/330
5,064,988 A * 11/1991 E'nama et al. ..... 42/103
5,124,515 A * 6/1992 Mous ..... 200/552
5,136,132 A * 8/1992 Kitchen ..... 200/529
5,164,273 A * 11/1992 Szasz et al. ..... 429/123
5,183,712 A * 2/1993 Bedlock et al. ..... 429/99
5,212,020 A * 5/1993 Inobe ..... 429/96
5,299,375 A * 4/1994 Thummel et al. ..... 42/103
5,323,555 A 6/1994 Jehn ..... 42/103
5,400,540 A * 3/1995 Solinsky et al. ..... 42/103
5,430,967 A * 7/1995 Woodman, III et al. ..... 42/103
5,471,777 A 12/1995 McDonald ..... 42/103
5,558,211 A * 9/1996 Heydner et al. ..... 200/552
5,581,898 A 12/1996 Thummel ..... 33/241
5,584,137 A * 12/1996 Teetzel ..... 42/103
5,590,484 A * 1/1997 Mooney et al. ..... 42/103
5,628,555 A 5/1997 Sharrah et al. ..... 362/114
5,634,553 A * 6/1997 Hopper et al. ..... 200/336
5,685,105 A * 11/1997 Teetzel ..... 42/103
5,704,155 A * 1/1998 Primeau, IV ..... 42/103
5,913,669 A * 6/1999 Hansen et al. ..... 42/103
5,945,645 A * 8/1999 Makuc et al. ..... 200/518
6,077,937 A * 12/1999 Ruiz Rodriguez et al. .. 429/159
6,099,147 A * 8/2000 Ziegenfuss ..... 362/319
6,115,952 A * 9/2000 Rigler ..... 42/103
6,276,088 B1 * 8/2001 Matthews et al. ..... 42/103

* cited by examiner

FIREARMS WITH TARGET ILLUMINATORS, ELECTRIC SWITCHING DEVICES AND BATTERY POWER SOURCES

FIELD OF INVENTION

The subject invention relates to firearms with target illuminators, to target illuminators for firearms, to electric lamp assemblies and to battery compartments and battery-driven appliances.

BACKGROUND

Electric switching devices and battery power sources and electric lamp assemblies have been known for a long time, but there persists a need for improvement, as this disclosure will demonstrate. The same applies to target illuminators in combination with firearms.

SUMMARY OF THE INVENTION

Against this background, the subject invention, resides in apparatus for firing projectiles at targets and for illuminating such targets, including a projectile-firing elongate weapon.

From a first aspect thereof, the invention resides in the improvement comprising, in combination, a fore-end structure disposable on that weapon, and a target illuminator on that fore-end structure in a first quadrant between a vertical plane and a horizontal plane longitudinally through such elongate weapon in a firing position of that weapon.

From a related aspect thereof, the invention resides in the improvement comprising, in combination, a fore-end structure disposable on that weapon, and a target illuminator on that fore-end structure including a housing in one piece with part of that fore-end structure.

From another aspect thereof, the invention resides in an electrical switching device, comprising, in combination, a self-contained electric ON/OFF switch having a projecting actuator, an angularly moveable actuator knob separate from that self-contained electric ON/OFF switch and projecting actuator, and a force-transmitting coupling from such angularly moveable actuator knob to the actuator of the electric ON/OFF switch.

From another aspect thereof, the invention resides in an electrical switching device, comprising, in combination, a rocker switch including a bistable rocker device including a pair of bistable toggles and a pivoted rocker arm between that pair of toggles alterable between a stable OFF position and an alternative stable ON position, and having a first manually engageable actuator for the OFF position, and a spaced manually engageable second actuator for the ON position.

From another aspect thereof, the invention resides in an electric battery of individually jacketed battery elements each having an individual positive terminal and an opposite individual negative terminal. The invention according to this aspect resides more specifically in the improvement comprising, in combination, a battery elements carrier having a positive common terminal and a separate negative common terminal, with the individually jacketed battery elements being individually insertable side by side into that carrier, with the individual positive terminals of said battery elements being at first side of said carrier, and the individual negative terminals of said battery elements being at an opposite second side of said carrier, and said individually jacketed battery elements being non-destructively individually removable from said carrier, and electrical circuitry interconnecting the individual terminals between the positive and negative common terminals of the carrier.

From a related aspect thereof, the invention also resides in an electric battery of individually jacketed battery elements each having an individual positive terminal and an opposite individual negative terminal. The invention according to this aspect resides more specifically in the improvement comprising, in combination, a battery elements carrier having a positive common terminal and a separate negative common terminal, and first and second compartments between opposite sides of that battery elements carrier, with first ones of the individually jacketed battery elements being individually insertable side by side into the first compartment, with individual positive terminals of these first battery elements being at the same side in that first compartment, and individual negative terminals of such first battery elements being at an opposite side in that first compartment, and with second ones of the individually jacketed battery elements being individually insertable side by side into the second compartment, with individual positive terminals of these second battery elements being at the same side in that second compartment, and individual negative terminals of such second battery elements being at an opposite side in that second compartment, all individually jacketed battery elements being non-destructively individually removable from these compartments, and electrical circuitry interconnecting the individual terminals between the positive and negative common terminals.

From another aspect thereof, the invention resides in an electric lamp assembly, and more specifically, in the improvement comprising, in combination, a support structure, a bezel structure on that support structure, a shock-absorbed reflector structure inside the bezel structure, including a reflector having a focal point, a first shock absorber between that reflector and the support structure and a second shock absorber between the bezel structure and that reflector, an electric light source having a luminous portion on the focal point in the reflector, and corresponding transverse and longitudinal luminous portion positioners at the light source and the reflector.

The invention resides also in combinations and permutations of these different aspects.

BRIEF DESTRUCTION OF THE DRAWINGS

The subject invention and its various aspects and objects will become more readily apparent from the following detailed description of preferred embodiments thereof, illustrated by way of example in the accompanying drawings which also constitute a written description of the invention, wherein like reference numerals designate like or equivalent parts, and in which.

DESCRIPTION OF PREFERRED EMBODIMENTS

The drawings show apparatus 10 for firing projectiles 11 at targets symbolically indicated at 13 and for illuminating such targets.

Figure 1:
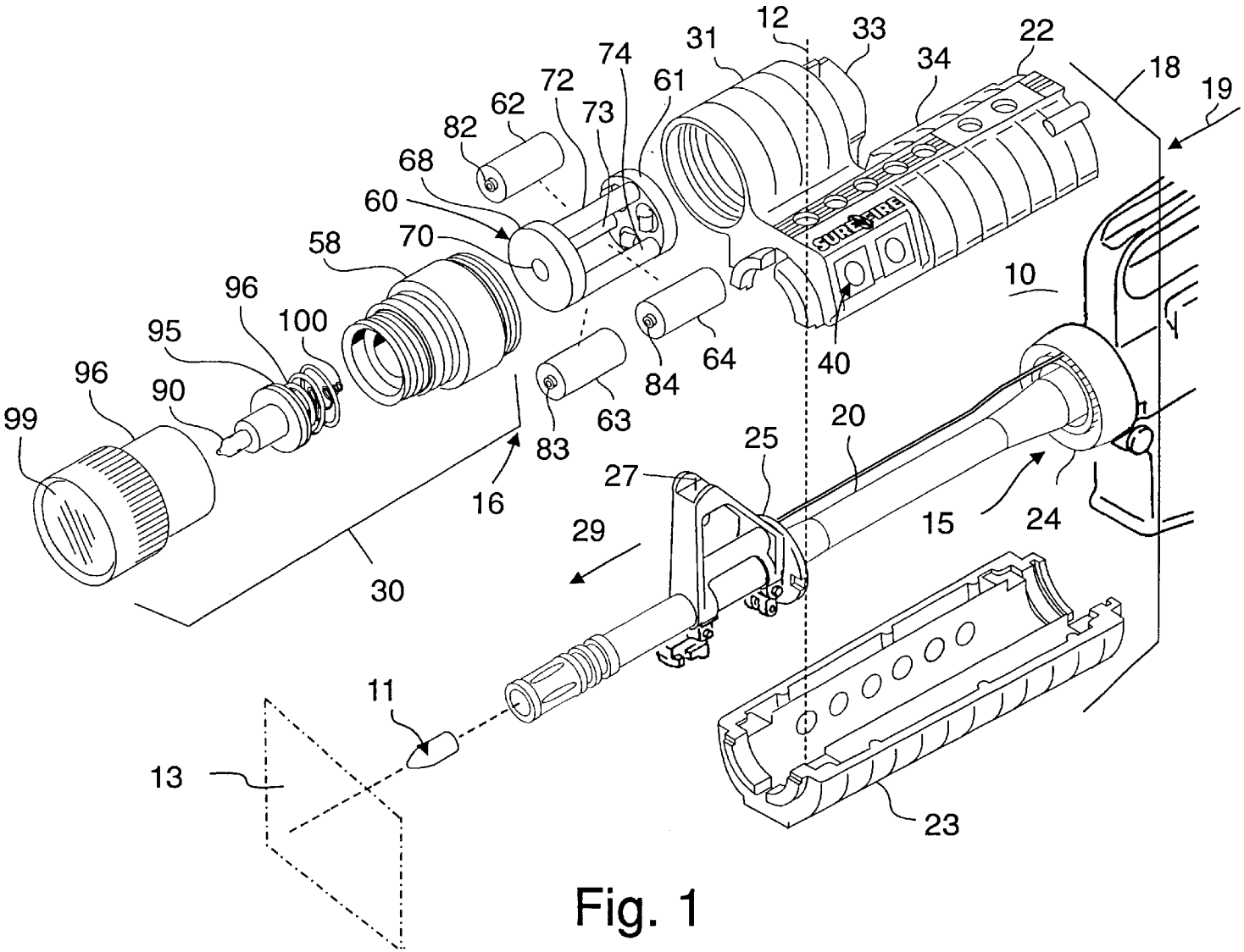
FIG. 1 is an exploded perspective view of a firearm, foreshortened in the back, with target illuminator according to a preferred embodiment of the invention.

FIG. 1 shows a handgun, firearm or other elongate projectile-firing weapon 15 and a target illuminator 16 in the apparatus 10. Such weapon is of a type that is manufactured with a standard fore-end structure (not shown) as is well known in the field of military and other weapons production.

An embodiment of the invention manufactures a replacement fore-end structure for that weapon, such as shown in FIG. 1, and integrates the target illuminator 16 with that replacement fore-end structure. The standard fore-end structure (not shown) is replaced with the replacement fore-end structure on the weapon, such as shown in FIG. 1.

Within the scope of the invention, fore-end structure 18 is mountable or otherwise disposable on weapon 15 and mounts the target illuminator 16 as well. According to an embodiment of the invention, the target illuminator 16 is located on the replacement or other fore-end structure 18 so as to be positioned in a first quadrant between a vertical plane (such as at a dotted line 12) and a horizontal plane (which extends at right angles thereto) longitudinally through the elongate weapon when the replacement or other fore-end structure 18 is on that weapon and such weapon is in its firing position, such as in the position shown in FIG. 1 for barrel 20 and sight 25.

The target illuminator 18 may then be in a relative position on the order of one-thirty to two o'clock on a vertical cross-section plane and relative to a midnight or noon indication 12, such as seen by looking in the direction of an arrow 19.

In this respect, indicating relative position in terms of a clock face is traditional in the armed forces and elsewhere, where a plane in space (in this case a vertical plane through the cross-section of the weapon's barrel 20) is considered to be numbered as a clock's face, with 12 o'clock considered as, in this case, straight up in vertical position, such as indicated in FIG. 1 by dotted line 12.

The relative position herein defined for the target illuminator 16 in effect is the position of that target illuminator's longitudinal axis which, as defined above, can be on the order of one-thirty to two o'clock in our indication of relative position.

According to the illustrated preferred embodiment of the invention, the fore-end structure 18 for the weapon 15 is composed of two halves which in practice may be upper and lower fore-ends or fore-end replacements 22 and 23 of the kind of weapon 15 shown in FIG. 1. For instance, the fore-end structure 18 or fore-end halves 22 and 23 may be mounted on the so-called hand guard slip ring 24 and hand guard cap 25 of the weapon 15.

The expression "fore-end" as herein employed is, however, not intended to be limited in any technical sense. Rather, such expression within the scope of the invention is intended to extend to all kind of handguards and other covers of weapon barrels and the like.

A foregrip (not shown) which may be of a conventional type, may be connected to the fore-end structure 18 or lower fore-end half 23 at six o'clock (i.e. on the dotted line opposite of the numeral 12), as seen on a vertical cross-section plane through the elongate weapon from an end of that elongate weapon 15, such as by looking in the above mentioned direction 19.

The illustrated weapon 15 includes a weapon sight 27. In the illustrated embodiment, this is the front sight of that weapon. In practice, such a front sight is paired with a rear sight which, however, is not seen in the foreshortened view of FIG. 1 and is not of importance here.

According to an embodiment of the invention, the target illuminator 16 is laterally offset from a weapon sight, which in FIG. 1 is the front sight 27, but which within the scope of the invention may be practically any visual, optical, opto-electronic or other sight.

The angular offset of the target illuminator 16 permits the weapon user to see around barricades or other obstacles which tend to obstruct the target 13 and to have otherwise a clear field of vision enhanced by operation of the target illuminator. The target illuminator 16 preferably extends beyond the sight in a projectile-firing direction 29, which in fact is the case in the embodiment illustrated in FIG. 1 after insertion of the lamp assembly 30 into a housing structure 31 of the target illuminator 16.

Housing structure 31 preferably is or is made in one piece with the fore-end structure 18 or its upper half 22.

The embodiment illustrated in FIG. 1 has a switch 33 for the target illuminator on a back of that target illuminator 16 or illuminator housing 31. By way of example, such switch may be of the type shown in FIGS. 4 and 5 and described more fully hereafter.

Alternatively or additionally, a switch 34 for actuation of the target illuminator 16 may be on the fore-end structure 18, such as on the upper fore-end structure half 22.

According to an embodiment of the invention, the switch 34 is a first switch for the target illuminator at one side of the fore-end structure 18, and there is a second switch 40 for that target illuminator 16 at another side of that fore-end structure 18 or of its upper half 22. By way of example, one of these first and second switches may be in the first quadrant mentioned above in connection with the target illuminator, such as at a relative position on the order of one-thirty to two-thirty o'clock as seen on a vertical cross-section plane through the elongate weapon from an end of that elongate weapon 15. The other of these first and second switches may be in a second quadrant between the above mentioned vertical and horizontal planes, such as at a relative position on the order of nine-thirty to ten-thirty o'clock as seen on the above mentioned vertical cross-section plane through that elongate weapon from an end of that elongate weapon, such as seen in the direction of arrow 19.

In this respect and in general, the above mentioned first quadrant may be the first quadrant, and the later second quadrant may in fact be the fourth quadrant of the above mentioned imaginary clock face. These two quadrants may be, and are then, adjacent each other.

In the embodiment of FIG. 1, it is the switch 34 that is in the first quadrant, such as at a relative position on the order of one-thirty to two-thirty o'clock as seen on a vertical cross-section plane through the elongate weapon 15 from an end of that elongate weapon, such as when looking in the direction of arrow 19. On the other hand, FIG. 1 shows switch 40 in the above mentioned second quadrant which may be the fourth quadrant of the imaginary clock face. Such second switch may thus be at a relative position on the order of nine-thirty to ten-thirty o'clock as seen on that vertical cross-section plane through the elongate weapon from an end of that elongate weapon.

One of the switches 34 and 40 may be a momentary switch, and the other of these switches may be an ON-OFF switch having a releasably continuous ON position.

Preferably, the switch 34 is a momentary switch, providing the weapon user with instantaneous light control. Momentary switches are old as such and include the so-called tape switches used in weapon systems. Their construction typically includes spaced electrodes in a flexible enclosure which are squeezed together and thus brought into electrical contact with each other by the weapon user when energization of the target illuminator is desired through an electrical circuit including these normally spaced electrodes (not shown, since conventional per se).

On the other hand, the other switch 40 preferably is an ON-OFF switch that may, for instance, be actuated with the thumb of the weapon user. Such switch typically has a releasably continuous ON position which uses the target illuminator 16 in a less nimble manner than the preferably momentary switch 34.

Within the scope of the invention, the ON-OFF function of the switch 40 may in principle be performed by the switch 33 instead. However, the embodiment illustrated in FIG. 1 prefers that the switch 33 be a target illumination enabling/disabling switch that permits the weapon user to positively prevent operation of the target illuminator, such as when preservation of absolute darkness is essential in cases where accidental actuation of the target illuminator, such as through accidental touching of either switch 34 or 40, would give away the weapon user's position to a dangerous criminal or enemy. Also, a disabler switch, such as at 33, is useful in preventing battery drain from inadvertent actuation of switches 34 and 40, such as by enclosures, bags or the like in which apparatus 10 may be temporarily stored or transported without removal of batteries 62 to 64 therefrom.

Figure 2:
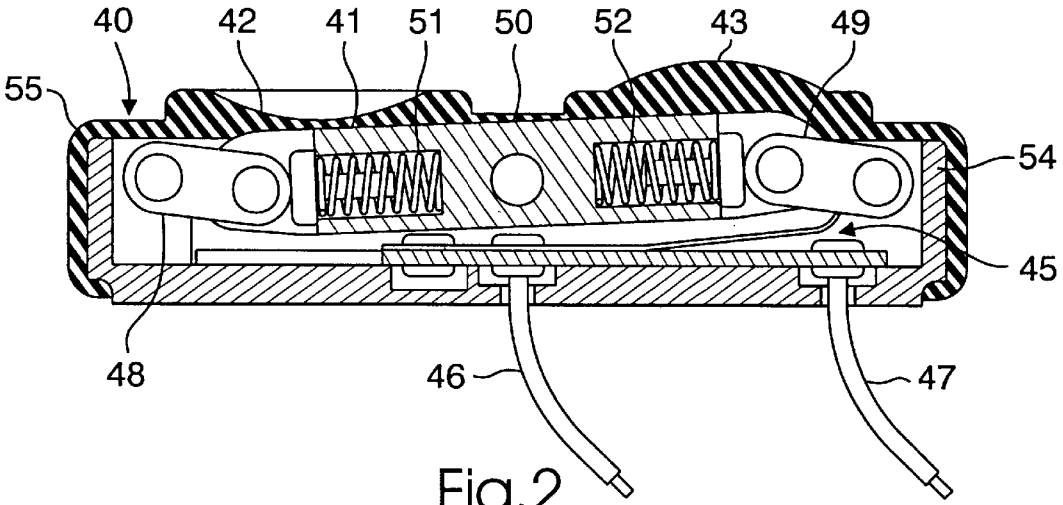
FIG. 2 is a sectioned side view of a rocker switch according to an embodiment of the invention, useable in or for the target illuminator of FIG. 1 or otherwise.

The switch 40 preferably is a rocker switch, such as shown in FIG. 2, including a bistable rocker device 41 alterable between a stable OFF position, such as shown in FIG. 2, and an alternative stable ON position which is the opposite of the position shown in FIG. 2. Rocker switch 40 has a first manually engageable actuator 42 for actuating the rocker switch to its OFF position, and a spaced manually engageable second actuator 43 for actuating the rocker switch to its ON position, such as by closure of a contact 45 between a pair of terminals 46 and 47.

These first and second actuators 42 and 43 may have differently structured tangible surfaces, so that the weapon user can reliably actuate the ON-OFF function in the dark or in other tight situations. By way of example, one of the first and second actuators, such as the actuator 43, may have a tangible convex surface, and the other of these first and second actuators, such as the actuator 42, may have a tangible concave surface, such as shown in FIG. 2.

Figure 3:
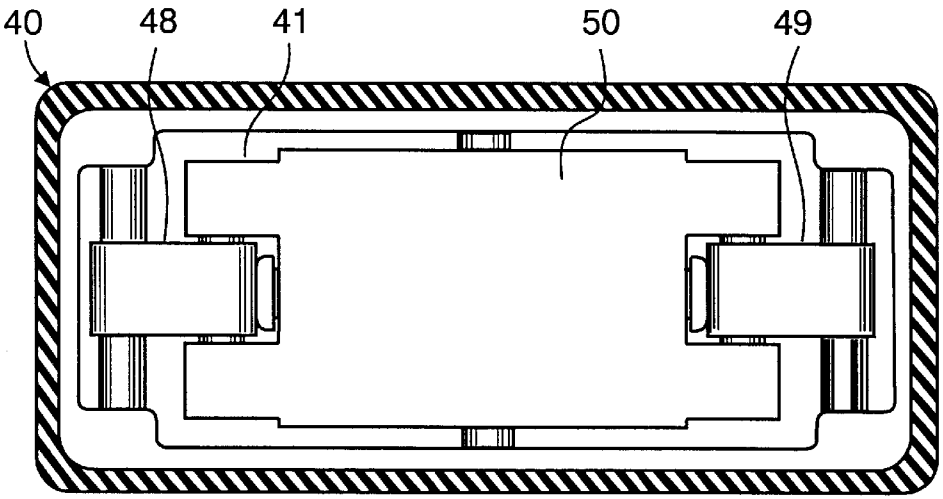
FIG. 3 is a top view, with cover removed, of the rocker switch of FIG. 2.

According to the illustrated preferred embodiment of this aspect of the invention, the bistable rocker device or switch 40 includes a pivoted rocker arm-and-toggle combination. By way of example, the bistable rocker device preferably includes a pair of bistable toggles 48 and 49 and a pivoted rocker arm 50 between that pair of toggles, such as shown in FIGS. 2 and 3. The rocker arm may have longitudinal bores accommodating compression springs 51 and 52 of the toggles 48 and 49.

The rocker and switch contact combination preferably is contained in a watertight housing 54 that is sealed by an elastomeric enclosure 55 which includes or provides the switch actuators 42 and 43 on the rocker arm 50 as seen in FIG. 2.

Although switch 40 is herein disclosed in combination with the target illuminator, it has excellent utility for various other switching applications.

A preferred embodiment of the invention includes a power source for the target illuminator 16 on the weapon 15. FIG. 1 shows the power source 60 combined with the target illuminator on the weapon. In fact, the target illuminator preferably includes a compartment for such power source, which may be composed of the above mentioned housing structure 31 that may be manufactured for the reception of batteries for powering the target illuminator.

Figure 10:
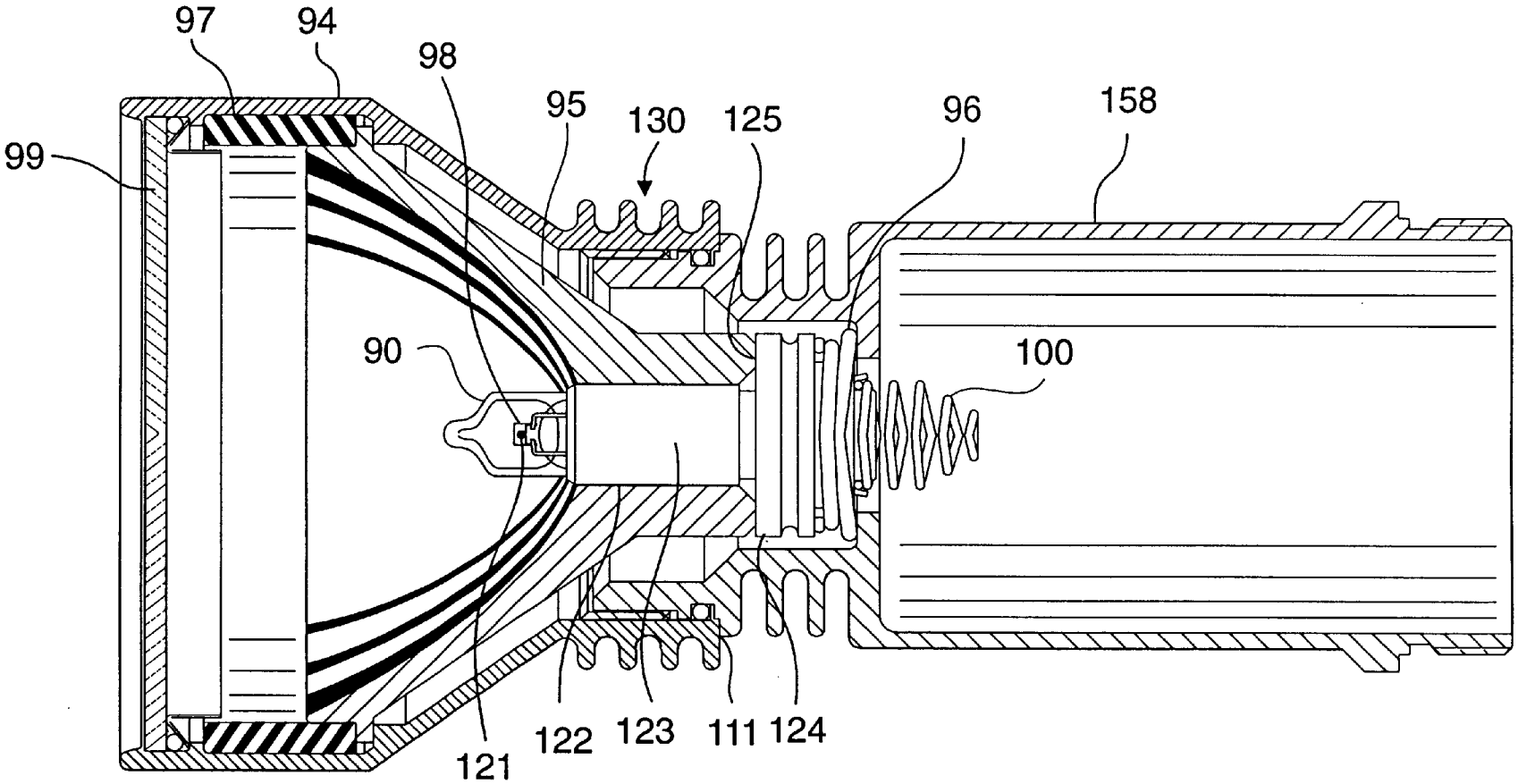
FIG. 10 is a partially sectioned side view of a lamp assembly according to an embodiment of the invention useable in the target illuminator of FIG. 1 or otherwise.

The target illuminator 16 also includes a part 58 of the lamp assembly 30, such as shown in FIG. 1, or of an alternative lamp assembly shown in FIG. 10, that is threaded into that housing structure 31.

According to a preferred embodiment of this aspect of the invention, the power source 60 comprises a battery 61 of individually jacketed elements 62, 63 and 64.

By way of comparison, a standard dictionary definition of the term battery in electrical terminology is "(1) a group of two or more elements connected together to furnish electric current, (2) a single voltaic element." Definition (1) is the original definition of the word battery. Definition (2) came into use when single voltaic elements became individually jacketed. Such modern duality of usage is reflected in The New IEEE Standard Dictionary of Electrical and Electronics Terms, published by The Institute of Electrical and Electronics Engineers (Fifth Edition, 1993), which provides the following definition:

> "battery (primary or secondary). Two or more cells electrically connected for producing electric energy. [Common usage permits this designation to be applied also to a single cell used independently. In this document, IEEE Std 100, unless otherwise specified, the term 'battery' will be used in this dual sense.]"

Contrary to such dual usage, the subject disclosure and accompanying claims use the term battery in the original sense to refer to (1) a group of two or more (primary or secondary) cells or battery elements connected together to furnish electric current. On the other hand, the subject disclosure and accompanying claims designate such cells as "individually jacketed battery elements" that are individually insertable into and non-destructively removable from the battery or battery carrier. This in contrast to multi-element batteries, such as the familiar lead-acid automobile batteries or certain multicell flashlight and other batteries in which the cells or elements are individually enclosed, but are not insertable into and removable from those batteries without destruction of a battery enclosure or similar structure if not of the cells themselves.

Figure 6:
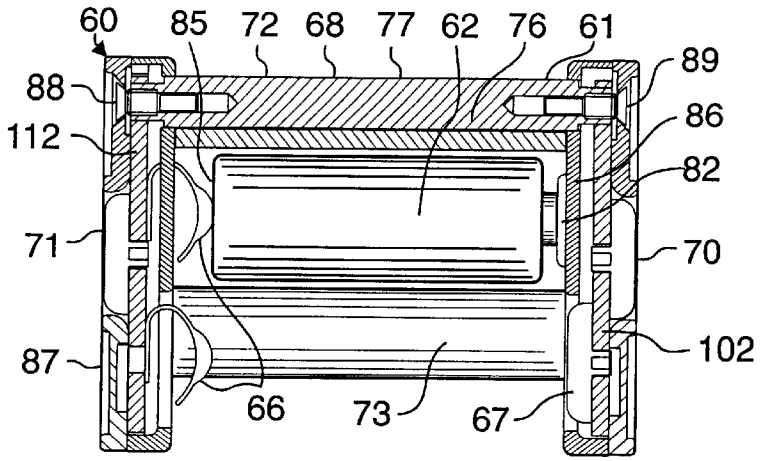
FIG. 6 is a sectioned side view of a battery structure according to an embodiment of the invention useable as a power source in or for the target illuminator of FIG. 1 or otherwise.
Figure 8:
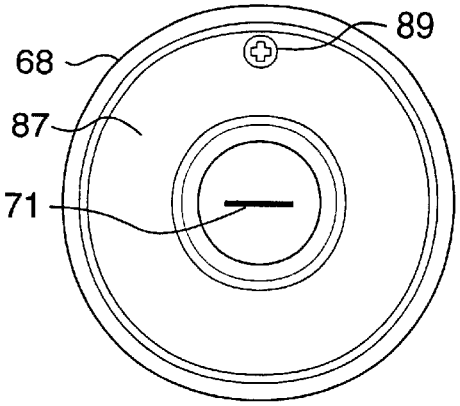
FIG. 8 is a bottom view of the battery structure of FIG. 6.
Figure 7:
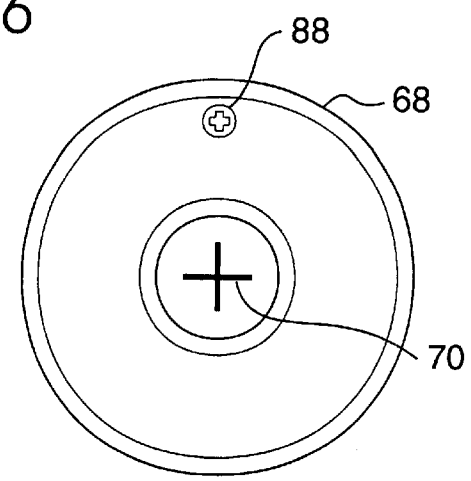
FIG. 7 is a top view of the battery structure of FIG. 6.

FIGS. 6 to 8 illustrate an electric battery 61 of individually jacketed battery elements 62, 63, 64 each having an individual positive terminal 82, 83, 84 and an opposite individual negative terminal 85, etc. According to the embodiment of the invention illustrated in FIGS. 6 to 8 and to some extent also in FIG. 9, the battery 61 includes a battery elements carrier 68 having a positive common terminal 70 and/or 87 and a spaced negative common terminal 71. Common positive and negative terminals 70 and 71 are shown in FIGS. 6 to 9 at opposite sides of the carrier 68. However, common positive and negative terminals may be on the same side, such as shown at 87 and 71, respectively in FIGS. 8 and 9. As seen particularly well in the perspective view of FIG. 1, the battery elements carrier 68 is laterally open on at least three sides for removal and insertion of individually jacketed battery elements 62, 63 and 64.

The individually jacketed battery elements 62, 63, 64 are individually insertable side by side into the carrier 68 or 168. As shown by dotted lines at 60 in FIG. 1, the individually jacketed battery elements 62, 63 and 64 are insertable in a direction substantially transverse to the longitudinal axis of the carrier, and preferably are radially inserted from the three sides of the battery elements carrier 68. The individual positive terminals 82, 83, 84 of such battery elements are at one side of the carrier 68, and the opposite individual negative terminals 85, etc., of these battery elements are at another side of that carrier. The individual jacketed battery elements 62, 63, 64 are non-destructively individually removable from the carrier 68. Electrical circuitry interconnects such individual terminals 82, 83, 84, 85, etc., between positive and negative common terminals 70 and/or 87 and 71. Within the scope of the invention as presently conceived, the individually jacketed battery elements 62, 63 and 64 may be electrically connected in parallel or in series.

By way of background, a widespread prior-art practice is to realize an electric series connection by arranging, for instance, the first and the third battery elements in the same direction, and the intermediate second battery element in the opposite direction, such as for series connection of the negative terminal of the first battery element to the positive terminal of the second battery element, and of the negative terminal of that second battery element to the positive terminal of the third battery element. While this would be within the scope of some aspects of the invention as herein disclosed, this would require the user of the weapon to be sure to insert the three batteries in proper alternating order for the desired series connection. Any mistake in this respect could seriously diminish the light output of the target illuminator 16 and/or could confuse and distract the user of the weapon through faulty operation, thereby frequently exposing such user to danger in hostile situations where reliance on the weapon and its perfect performance are of the essence.

The presently disclosed preferred embodiment of the invention precludes such danger by arranging the individually insertable and replaceable battery elements 62, 63 and 64 so that they have all of their positive terminals 82, 83 and 84 on the same side in the carrier 68, which, of course, means that they have all of their negative terminals 85, etc., on the opposite side.

In practice, this is a great convenience, since the user can quickly insert or replace the battery elements without needing to be concerned as to which battery element has to be inserted the opposite way from the other battery elements to make up the battery from several battery elements. Such a convenience can become a life saver when rapid restoration of a worn power source 60 through quick replacement of the individually jacketed elements with fresh elements 62, 63 and 64 is essential to the proper functioning of the target illuminator 16 and thereby of the weapon 15 and to the safety of its user.

Also, the side-by-side arrangement of the individual batteries 62, 63 and 64 effectively avoids the recoil-related battery damage encountered in "in-line" battery systems in which two or more individually jacketed elements are arranged mechanically in series, with positive and negative terminals of adjacent elements being biased against and touching each other. In the illustrated embodiment of this aspect of the invention, each of the individually jacketed elements 62, 63 or 64 is individually supported by current pickup contacts 66 that act as individual shock absorbers therefor. Such shock-absorbing terminals 66 for each of the individually jacketed elements are seen in FIG. 6 and again in FIG. 9.

In the embodiment shown in FIG. 6, all positive terminals 82, 83, 84 of the battery elements 62, 63, 64 are on the side of the positive common terminal 70, and all negative terminals 85, etc., are on the side of the negative common terminal 71. However, within the scope of the invention, the positive terminals 82 to 84 could be on the side of the negative common terminal, and the negative terminals 85, etc., conversely could be on the side of the positive common terminal. In either case there is electrical circuitry in the carrier 68 to interconnect the individual terminals 82, 83, 84, 85, etc., between positive and negative common terminals 70 and/or 87 and 71.

The illustrated carrier 68 is laterally open for removal and insertion of the individually jacketed elements 62, 63 and 64. By way of example, the battery element carrier 68 may have mutually spaced posts 72, 73 and 74 extending between and supporting opposite ends of the carrier that contain the common positive and negative battery terminals 70 and 71. These carrier posts may be electrically insulating, at least at the outside thereof. However, at least some of these carrier posts may be part electrically conducting and part electrically insulating. For instance, at least some of these posts may have a longitudinal electrical conductor 76 in a hollow-cylindrical electrically insulating tube 77 or similar insulation, such as shown for one of these carrier posts in FIG. 6. Such posts or conductors may accommodate fasteners 88 and 89 for holding together parts of the carrier 68 or even for completing electrical circuits therein, such as via circuit boards 102 and 112. Further current pickup or conducting terminals may be provided in the carrier 68, such as for battery terminals 82, 83, 84.

By way of example, where electrical series connection of the three individually jacketed battery elements 62, 63 and 64 is desired, at least two of the electrical conductors in posts 72 to 74 can be used to electrically connect these battery elements in series, even if they are mechanically arranged side by side in parallel. Once this principle of this aspect of the invention has been understood, suitable interconnections of battery elements through posts 72 (76), 73 etc., and interconnecting leads in circuit boards 102 and 112 in conjunction with carrier terminals 66, 67 and 68 such as shown in FIG. 6 can readily be designed or effected by an electrical engineer of ordinary skill using conventional technology.

Figure 9:
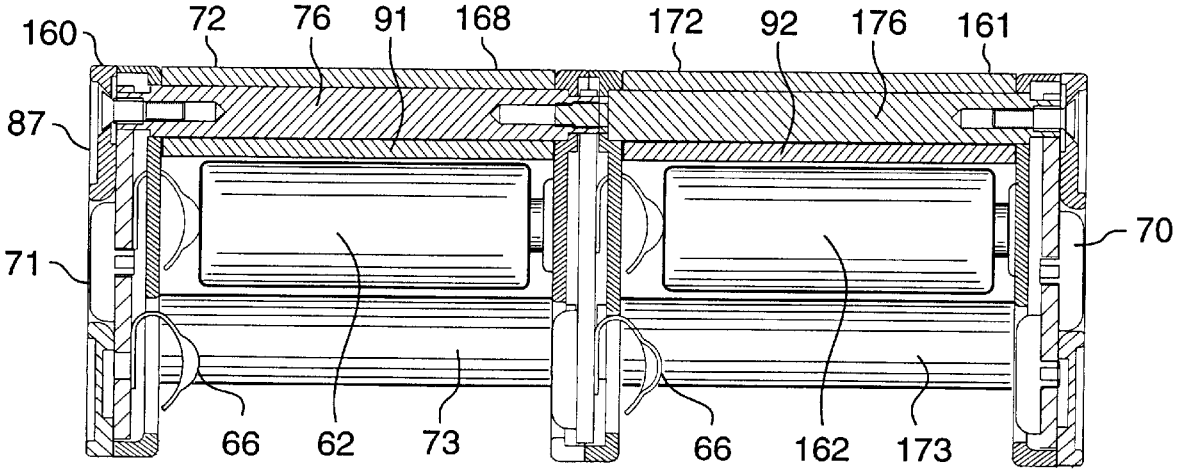
FIG. 9 is a sectioned side view of an expanded battery structure according to an embodiment of the invention useable as a power source in or for the target illuminator of FIG. 1 or otherwise.

The embodiments shown in FIGS. 6 to 9 provide at least one further common terminal 87 at least one of the sides of the carrier, such as at the side seen in FIGS. 6, 8 and 9, and electrically interconnects such further common terminal with one of the other terminals, such as with the positive common terminal 70, such as through an electrical conductor in a third one of the posts 72 to 74. Within the scope of the invention, the third common terminal 87 may, however, be interconnected with any terminal inside the battery or with at least one of the individual terminals of the battery elements.

Figure 4:
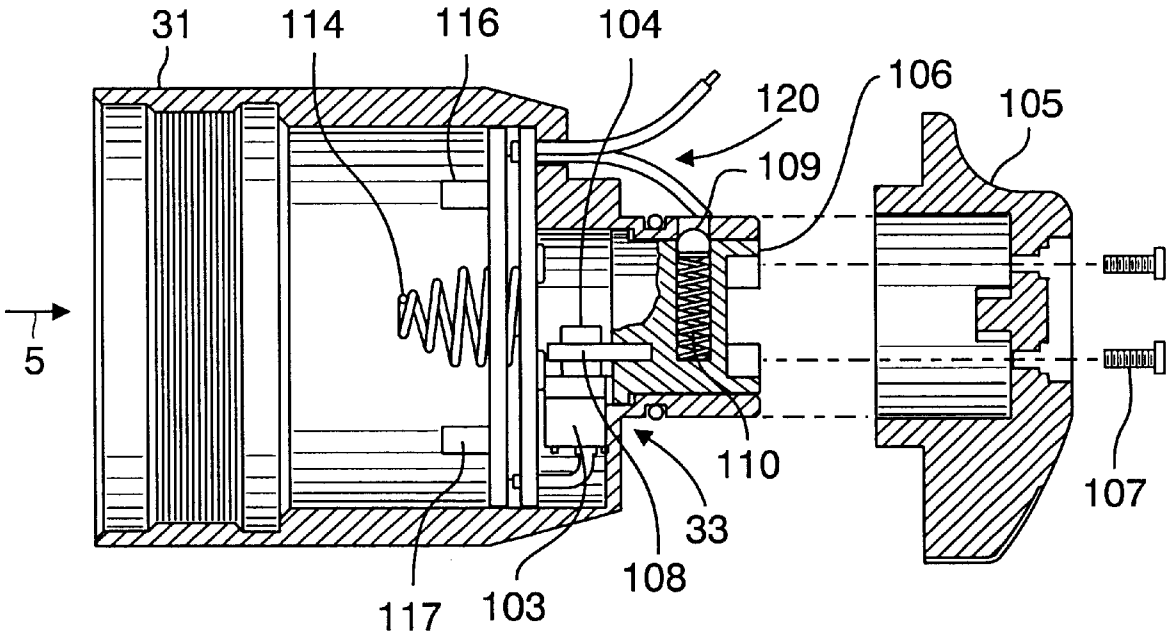
FIG. 4 is a sectional view of a switch according to an embodiment of the invention, useable in or for the target illuminator of FIG. 1 or otherwise.

In this or any other manner within the scope of the invention, the battery 61 has a common terminal of one polarity, such as a common positive terminal 70 on one side, and a pair of common positive and negative terminals 87 and 71 on the other side of the battery element carrier 68. In practice, this has the advantage that at least one further accessory or other load may be energized by the battery 61, in addition to the load, such as a lamp 90 of the target illuminator 16. By way of example, a terminal connector may be provided in the housing structure 31 of the target illuminator 16 for connection of another load to the battery 61 via its common terminals 71 and 87. Such additional terminal connector is not visible in FIG. 1, since it typically would be located at the back of the housing structure 31. However, leads 120 are shown in FIG. 4 as terminals for switched and unswitched battery currents and a terminal connector may be used instead.

FIG. 9 shows a power source 160 which is related in conception and principle to the power source 60 of FIGS. 1, 6, 7 and 8. Accordingly, like reference numerals are employed for like parts. However, to avoid confusion, some reference numerals in FIG. 9 are augmented by one hundred (e.g. 160 instead of 60, and the like) relative to their counterparts in FIG. 6, for instance.

Accordingly, the electric battery 161 is also composed of individually jacketed battery elements each having an individual positive terminal and an opposite individual negative terminal, and of a battery elements carrier 168 having a positive common terminal 70 at a first carrier side and a negative common terminal 71 at an opposite second carrier side and/or separate positive and negative common terminals 87 and 71 at the same side of the carrier.

The carrier 168 shown in FIG. 9 also has first and second compartments 91 and 92 between opposite sides of the battery elements carrier 168. Individually jacketed battery elements 62, 63, 64 (see FIG. 1), etc., are individually insertable and non-destructively removable from these first and second compartments.

In particular, first ones of the individually jacketed battery elements 62, etc., such as seen in FIG. 1 and at the left-hand side of FIG. 9, are individually insertable side by side into the first compartment 91, with individual positive terminals of these first battery elements 62, etc., being at the same side in that first compartment, and individual negative terminals of these first battery elements being at an opposite side in such first compartment.

Similarly, second ones of the individually jacketed battery elements 162, etc., are individually insertable side by side into the second compartment 92, with individual positive terminals of such second battery elements being at the same side in that second compartment, and individual negative terminals of such second battery elements being at an opposite side in that second compartment.

All individually jacketed battery elements also are non-destructively individually removable from compartments 91 and 92. Electrical circuitry interconnects the individual terminals between positive and negative common terminals 70, 87 and 71, such as via electrically conductive posts 76 and 176, 73 and 173, protected by insulating jackets 72 and 172, etc.

The first and second compartments 91 and 92 may be laterally open for removal and insertion of all individually jacketed elements 62, 162, etc. Such first and second compartments 91 and 92 may be in series between positive and negative common terminals 70 and 71.

A further common terminal 87 may be on the expanded carrier 168, and electric circuitry may interconnect such further common terminal with one of the other terminals, such as to provide different voltages and currents from the individually jacketed battery elements, or from any grouping thereof. By way of example, the additional common terminal, such as 87, may in fact be a common terminal for only one of the battery sections, such as for the section of battery elements contained in the carrier compartment 92. This is particularly advantageous if the power source 160 is to serve two different loads.

By way of example, different loads may include alternate first and second target illuminators or a target illuminator and a red-dot type or other battery operated firearm sight.

Of course, the batteries 61 and 161 as herein disclosed and their equivalents within the currently discussed aspect of the invention are of utility in fields other than target illuminators, flashlights and the like and may, for instance, take the place of many commercially available prior-art batteries.

FIG. 10 shows a lamp assembly 130 that may be used in, or in substitution of part of, the target illuminator 16 of FIG. 1, in a flashlight, or in another electric light source. By way of example, the lamp assembly may be used in conjunction with the target illuminator housing structure 31 shown in FIG. 1, but this aspect of the invention is not so limited.

According to the currently disclosed aspect of the invention, the electric lamp assembly 130 has a support structure 158, a bezel structure 94 on that support structure and a shock-absorbed reflector structure inside that bezel structure. Such shock-absorbed reflector structure includes a reflector 95 having a focal point 121, a first shock absorber, such as a helical spring 96, between that reflector 95 and the support structure 158, and a second shock absorber, such as an elastomeric annulus 97, between bezel structure 94 and reflector 95. An electric light source 90 has a filament or other luminous portion 98 on the focal point 121 of the preferably parabolic reflector 95.

In practice, high-quality light sources and illumination requirements place extraordinary precision on the coincidence of a point-like luminous portion 98 of the light source with the focal point 121 of the reflector, not only for the originally provided light source, but for every replacement thereof. In principle, conventional corresponding transverse and longitudinal luminous portion positioners at the light source and the reflector can be used for that purpose, such as in the form of a typically cylindrical socket 123 of the light source 90 in a corresponding longitudinal bore 122 of the reflector 95 and corresponding limit stops or shoulders 124 and 125 on the socket 123 and reflector 95. That as such, however, will not: solve the problem of displacement of the filament/focal point coincidence through heavy recoil action during firing of weapons if the lamp assembly 130 is, for instance, used in target illuminators, or through other kind of shock actions, if such lamp assembly is used in other applications, such as in flashlights and other light sources of law enforcement or military personnel.

However, the currently disclosed combination of a shock absorbing suspension of the reflector 95, such as between shock absorbers 96 and 97 and the basically known transverse and longitudinal luminous portion positioners 122 to 125 or equivalent structure, does solve such problems and maintains the filament 98 or similar light point source in coincidence with the reflector's focal point.

A lens or other transparent cover 99 may be installed in the bezel 94. The limit stop 124 may be part of a terminal assembly including a spring 100 for connecting the lamp 90 to a battery or other electric power source.

As shown in FIG. 10, the first shock absorber 96 may be between the limit stop 124 of the socket 123 and the support structure 158. A lateral heat radiator 111 on at least one if not both of the support structure 158 and bezel structure 94 may be used to divert heat from the light source 90 and thereby prevent thermally induced displacement of luminous portion 98 and focal point 121 through warping of parts and otherwise.

A power source is connectable to the electric light source 90, such as through terminal spring 100 and through parts 158, 96 and 124, if electrically conductive. The support structure 158 may include a compartment for such power source and may, for instance, be hollow-cylindrical for that purpose. The lamp assembly part 158 may correspond to part 58 of the lamp assembly 30 shown in FIG. 1, and may be threaded into the housing structure 31 of the target illuminator 16, and together with such housing structure may provide an overall housing for the battery 60 and even for the expanded battery 160, if the part 158 is made sufficiently long for that purpose. The subject disclosure thus illustrates a system or method of making alternate first and second target illuminators for a weapon, such as shown in FIGS. 1 and 10, making a housing structure 31 for such alternate first and second target illuminators attachable to that weapon, such as via a dedicated fore-end structure 18 or otherwise, making different first and second batteries for the first and second target illuminators, such as shown in FIGS. 6 to 9, jointly accommodating the first battery 61 with the housing structure 31 and the first target illuminator 16 including structure 30 or part 58, and alternatively jointly accommodating the second battery 161 with the common housing structure 31 and with the second target illuminator shown in FIG. 10, in substitution of the first battery 61 and first target illuminator 16.

Various other features herein disclosed may be combined with embodiments of this aspect of the invention, including features of various batteries herein disclosed.

Figure 5:
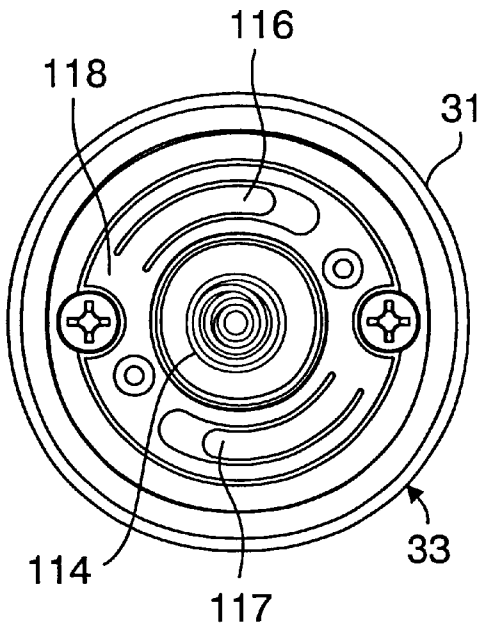
FIG. 5 is an elevational view of the switch as seen in the direction of arrow 5 in FIG. 4.

Reverting to the electrical switching device 33 shown in FIGS. 1, 4 and 5, such device according to the currently disclosed aspect of the invention comprises a self-contained electric ON/OFF switch 103 having a projecting actuator 104, an angularly moveable actuator knob 105 separate from that self-contained electric ON/OFF switch and projecting actuator, and a force-transmitting coupling 106 from that angularly moveable actuator knob 105 to the actuator 104 of the electric ON/OFF switch 103. Fasteners 107 may attach the knob 105 to the coupling 106.

According to a preferred embodiment of this aspect of the invention, the ON/OFF switch 103 is an electric slide switch having a slide actuator at 104, and the force-transmitting coupling and such slide actuator constitute an angular motion-to-translatory motion converter. As its given name implies, such converter converts the angular motion of the actuator knob 105 to the translatory motion required for ON/OFF actuation of slide switch 103. The sliding actuator 104 of that slide switch 103 may be contained between a pair of pins that project from the angularly movable coupling 106, such as seen for one of these pins at 108.

In other words, the switching device pursuant to the embodiment illustrated in FIGS. 4 and 5 has a switch 103 comprising a translatory actuator 104 and an angularly moveable actuator 105 coupled to that translatory actuator 104.

A detent with a ball 109 and bias spring 110 may releasably retain the angularly moveable knob 105 and its coupling 106 in either of at least two positions determined by apertures in the housing of the switching device 33 or rotary coupling 106.

That housing may be the or part of the housing 31 that according to FIG. 1 may be integral or in one part with fore-end structure 18. Additionally or alternatively, such housing 31 may be a housing for at least part of an electric battery 62, etc. A battery terminal contact 114 may be connected to the electric ON/OFF switch 103.

A separate second battery terminal contact 116 may also be provided in housing 31. Such additional terminal contact 116 may, for instance, contact the further common terminal 87 shown in FIG. 8 and described above. The central terminal spring 114 on the other hand may contact the negative common battery terminal 71 of a battery of the type shown in FIGS. 6 to 8 and described above.

The second battery terminal contact 116 may be paired by a corresponding contact 117. Both of these contacts 116 and 117 may be curved leaf springs worked out of a terminal plate 118, such as for better contact with the extra battery terminal 87 that may be of opposite polarity to the central battery terminal 71.

In this manner, the illustrated embodiment of this aspect of the invention is capable of supplying switched and unswitched battery currents of both polarities, such as for the energization of target illuminator 16 and other accessories.

In this respect, while external leads 120 are shown in FIG. 4 for supplying switched and unswitched electric currents from internal batteries, it is a feature of a preferred embodiment of the invention that all or at least most of the leads to and from switches 34 and 40 can run internally through housing 31 and fore-end structure 18 or 22 without exposure to inclement weather and other adverse conditions.

This extensive disclosure will render apparent or suggest to those skilled in the art various modifications and variations within the spirit and scope of the invention.

We claim:

1. In apparatus for firing projectiles at targets and for illuminating said targets, including a projectile-firing weapon, the improvement comprising in combination:

a target illuminator disposable on said weapon; and an electrical switching device for said target illuminator comprising a self-contained electric ON/OFF slide switch having a projecting actuator, an angularly moveable actuator knob separate from said self-contained electric ON/OFF switch and projecting actuator, and a force-transmitting coupling from said angularly moveable actuator knob to said actuator of said electric ON/OFF switch including an angular motion-to-translatory motion converter.

2. Apparatus as in claim 1, including:

a housing for at least part of an electric battery; and a battery terminal contact connected to said electric ON/OFF switch.

3. Apparatus as in claim 1, including:

a housing for at least part of an electric battery;

a first battery terminal contact in said housing connected to said electric ON/OFF switch; and a separate second battery terminal contact in said housing.

4. In apparatus for firing projectiles at targets and for illuminating said targets, including a projectile-firing weapon, the improvement comprising in combination:

a target illuminator disposable on said weapon; and a switch for actuation of said target illuminator, said switch being a rocker switch including a bistable rocker device alterable between a stable OFF position and an alternative stable ON position, and having a first manually engageable actuator for said OFF position, and a spaced manually engageable second actuator for said ON position, said bistable rocker device including a pivoted rocker arm-and-toggle combination including a pair of bistable toggles.

5. Apparatus as in claim 4, wherein:

said first and second actuators have differently structured tangible surfaces.

6. Apparatus as in claim 5, wherein:

one of said first and second actuators has a tangible convex surface; and the other of said first and second actuators has a tangible concave surface.

7. In apparatus for firing projectiles at targets and for illuminating said targets, including a projectile-firing weapon, the improvement comprising in combination:

a target illuminator disposable on said weapon; and a switch for actuation of said target illuminator, said switch being a rocker switch including a bistable rocker device alterable between a stable OFF position and an alternative stable ON position, and having a first manually engageable actuator for said OFF position, and a spaced manually second actuator for said ON position, said bistable rocker device including a pair of bistable toggles and a pivoted rocker arm between said pair of bistable toggles.

8. Apparatus as in claim 7, wherein:

said first and second actuators have differently structured tangible surfaces.

9. Apparatus as in claim 8, wherein:

one of said first and second actuators has a tangible convex surface; and the other of said first and second actuators has a tangible concave surface.

10. In apparatus for firing projectiles at targets and for illuminating said targets, including a projectile-firing weapon having an elongate barrel, the improvement comprising in combination:

a fore-end structure disposable on said weapon;

a target illuminator on said fore-end structure including a housing and positioned above and laterally of said barrel when said fore-end structure is disposed on said weapon in a firing position of said weapon; and an electrical switching device for said target illuminator comprising a self-contained electric ON/OFF slide switch having a projecting actuator, an angularly moveable actuator knob separate from said self-contained electric ON/OFF switch and projecting actuator, and a force-transmitting coupling from said angularly moveable actuator knob to said actuator of said electric ON/OFF switch including an angular motion-to-translatory motion converter.

11. Apparatus as in claim 10, wherein:

said target illuminator includes a housing in one piece with part of said fore-end structure.

12. Apparatus as in claim 10, wherein:

said projectile-firing elongate weapon is manufactured with a standard fore-end structure; and said fore-end structure disposable on said weapon is a replacement of said standard fore-end structure.

13. Apparatus as in claim 10, wherein:

said housing contains at least part of an electric battery and a battery terminal contact connected to said electric ON/OFF switch.

14. Apparatus as in claim 10, wherein:

said housing contains at least part of an electric battery, a first battery terminal contact connected to said electric ON/OFF switch, and a separate second battery terminal contact.

15. In apparatus for firing projectiles at targets and for illuminating said targets, including a projectile-firing weapon having an elongate barrel, the improvement comprising in combination:

a fore-end structure disposable on said weapon;

a target illuminator on said fore-end structure and positioned above and laterally of said barrel when said fore-end structure is disposed on said weapon in a firing position of said weapon; and a rocker switch for actuation of said target illuminator on said fore-end structure, said rocker switch including a bistable rocker device alterable between a stable OFF position and an alternative stable ON position, and having a first manually engageable actuator for said OFF position, and a spaced manually engageable second actuator for said ON position, said bistable rocker device including a pivoted rocker arm-and-toggle combination.

16. In apparatus for firing projectiles at targets and for illuminating said targets, including a projectile-firing weapon having an elongate barrel, the improvement comprising in combination:

a fore-end structure disposable on said weapon;

a target illuminator on said fore-end structure and positioned above and laterally of said barrel when said fore-end structure is disposed on said weapon in a firing position of said weapon; and a rocker switch for actuation of said target illuminator on said fore-end structure, said rocker switch including a bistable rocker device alterable between a stable OFF position and an alternative stable ON position, and having a first manually engageable actuator for said OFF position, and a spaced manually engageable second actuator for said ON position, said bistable rocker device including a pivoted rocker arm-and-toggle combination including a pair of bistable toggles.

17. Apparatus as in claim 16, wherein:

one of said first and second actuators has a tangible convex surface; and the other of said first and second actuators has a tangible concave surface.

18. Apparatus as in claim 16, wherein:

said projectile-firing elongate weapon is manufactured with a standard fore-end structure; and said fore-end structure disposable on said weapon is a replacement of said standard fore-end structure.

19. Apparatus as in claim 16, wherein:

said first and second actuators have differently structured tangible surfaces.

20. Apparatus as in claim 19, wherein:

one of said first and second actuators has a tangible convex surface; and the other of said first and second actuators has a tangible concave surface.

21. Apparatus as in claim 16, wherein:

said target illuminator includes a housing in one piece with part of said fore-end structure.

22. In apparatus for firing projectiles at targets and for illuminating said targets, including a projectile-firing weapon having an elongate barrel, the improvement comprising in combination:

a fore-end structure disposable on said weapon;

a target illuminator on said fore-end structure and positioned above and laterally of said barrel when said fore-end structure is disposed on said weapon in a firing position of said weapon; and a rocker switch for actuation of said target illuminator on said fore-end structure, said rocker switch including a bistable rocker device alterable between a stable OFF position and an alternative stable ON position, and having a first manually engageable actuator for said OFF position, and a spaced manually engageable second actuator for said ON position, said bistable rocker device including a pair of toggles and a pivoted rocker arm between said pair of toggles.

23. In apparatus for firing projectiles at targets and for illuminating said targets, including a projectile-firing weapon having an elongate barrel, the improvement comprising in combination:

a fore-end structure disposable on said weapon;

a target illuminator on said fore-end structure and positioned above and laterally of said barrel when said fore-end structure is disposed on said weapon in a firing position of said weapon; and a rocker switch for actuation of said target illuminator on said fore-end structure, said rocker switch including a bistable rocker device alterable between a stable OFF position and an alternative stable ON position, and having a first manually engageable actuator for said OFF position, and a spaced manually engageable second actuator for said ON position, said bistable rocker device including a pair of bistable toggles and a pivoted rocker arm between said pair of bistable toggles.

24. Apparatus as in claim 23, wherein:

said first and second actuators have differently structured tangible surfaces.

25. Apparatus as in claim 24, wherein:

one of said first and second actuators has a tangible convex surface; and the other of said first and second actuators has a tangible concave surface.

26. In apparatus for firing projectiles at targets and for illuminating said targets, including a projectile-firing weapon, the improvement comprising in combination:

a target illuminator disposable on said weapon;

a power source combined with said target illuminator, said power source being a removable electric battery of individually jacketed battery elements each having an individual positive terminal and an opposite individual negative terminal;

said battery including a battery elements carrier having a positive common terminal and a separate negative common terminal;

said individually jacketed battery elements individually insertable side by side into said carrier, with the individual positive terminals of said battery elements being at a first side of said carrier, and the individual negative terminals of said battery elements being at an opposite second side of said carrier, and said individually jacketed battery elements non-destructively individually removable from said carrier; and electrical circuitry interconnecting said individual terminals between said positive and negative common terminals.

27. Apparatus as in claim 26, wherein:

said carrier is laterally open for removal and insertion of said individually jacketed elements.

28. Apparatus as in claim 26, including:

a further common terminal at one of said sides of said carrier; and an electric circuit interconnecting said further common terminal with one of said terminals.

29. Apparatus as in claim 26, including:

a switch for actuation of said target illuminator on said fore-end structure.

30. Apparatus as in claim 29, wherein:

said switch is a momentary switch.

31. Apparatus as in claim 29, wherein:

said switch is an ON-OFF switch.

32. Apparatus as in claim 31, wherein:

said switch has a releasably continuous ON position.

33. Apparatus as in claim 29, wherein:

said switch is a rocker switch including a bistable rocker device alterable between a stable OFF position and an alternative stable ON position, and having a first manually engageable actuator for said OFF position, and a spaced manually engageable second actuator for said ON position.

34. Apparatus as in claim 33, wherein:

said first and second actuators have differently structured tangible surfaces.

35. Apparatus as in claim 34, wherein:

one of said first and second actuators has a tangible convex surface; and the other of said first and second actuators has a tangible concave surface.

36. Apparatus as in claim 33, wherein:

said bistable rocker device includes a rocker arm, and said first and second actuators have differently structured tangible surfaces on said rocker arm.

37. Apparatus as in claim 36, wherein:

one of said first and second actuators has a tangible convex surface; and the other of said first and second actuators has a tangible concave surface.

38. Apparatus as in claim 33, wherein:

said bistable rocker device includes a pivoted rocker arm-and-toggle combination including a pair of bistable toggles.

39. Apparatus as in claim 33, wherein:

said bistable rocker device includes a pair of bistable toggles and a pivoted rocker arm between said pair of bistable toggles.

40. Apparatus as in claim 26, wherein:

said carrier is laterally open on at least three sides for removal and insertion of said individually jacketed elements.

41. Apparatus as in claim 40, wherein:

said individually jacketed elements are radially inserted from said three sides in said carrier.

42. Apparatus as in claim 26, wherein:

one of said positive common terminal and negative common terminal is at one side of said carrier;

the other of said positive common terminal and negative common terminal is at an axially opposite side of said carrier;

a further common terminal at one of said sides of said carrier; and an electric circuit interconnects said further common terminal with one of said terminals.

43. Apparatus as in claim 26, further including a fore-end structure disposable on said weapon, and wherein said target illuminator is on said fore-end structure and includes a housing in one piece with part of said fore-end structure.

44. Apparatus as in claim 43, wherein:

said fore-end structure has an upper fore-end; and said housing of said target illuminator is in one piece with said upper fore-end.

45. Apparatus as in claim 44, wherein:

said weapon includes a weapon sight; and said target illuminator is laterally offset from said sight.

46. In an electrical switching device, the improvement comprising in combination:

a rocker switch having a watertight housing, said rocker switch including a bistable rocker device including a pair of bistable toggles and a pivoted rocker arm between said pair of bistable toggles with a pair of compression springs respectively acting upon said bistable toggles alterable between a stable OFF position and an alternative stable ON position, and having a first manually engageable actuator for said OFF position and a spaced manually engageable second actuator for said ON position.

47. Apparatus as in claim 46, wherein:

said rocker arm has longitudinal bores accommodating said compression springs.

48. Apparatus as in claim 46, wherein:

said watertight housing is sealed by an elastomeric enclosure.

49. Apparatus as in claim 48, wherein:

said elastomeric enclosure has first and second switch actuators.

50. Apparatus as in claim 49, wherein:

said first and second actuators have differently structured tangible surfaces.

51. Apparatus as in claim 50, wherein:

one of said first and second actuators has a tangible convex surface; and the other of said first and second actuators has a tangible concave surface.

52. In an electric battery of individually jacketed battery elements each having an individual positive terminal and an opposite individual negative terminal, the improvement comprising in combination:

a battery elements carrier having a positive common terminal and a separate negative common terminal and being laterally open on at least three sides for removal and insertion of said individually jacketed elements;

said individually jacketed battery elements individually insertable side by side into said carrier from said at least three sides in a direction substantially transverse to the longitudinal axis of said carrier, with the individual positive terminals of said battery elements being at a first side of said carrier, and the individual negative terminals of said battery elements being at an opposite second side of said carrier, and said individually jacketed battery elements nondestructively individually removable from said carrier; and electrical circuitry interconnecting said individual terminals between said positive and negative common terminals.

53. An electric battery as in claim 52, wherein:

said individually jacketed elements are radially inserted from said at least three sides in said carrier.

54. An electric battery as in claim 52, wherein:

one of said positive common terminal and negative common terminal is at one side of said carrier, the other of said positive common terminal and negative common terminal is at an axially opposite side of said carrier;

a further common terminal at one of said sides of said carrier; and an electric circuit interconnects said further common terminal with one of said terminals.

* * * * *

UNITED STATES PATENT AND TRADEMARK OFFICE

CERTIFICATE OF CORRECTION

PATENT NO. : 6,345,464 B1 
DATED : February 12, 2002
INVENTOR(S) : Paul Youngcho Kim and John Wallace Matthews It is certified that error appears in the above-identified patent and that said Letters Patent is hereby corrected as shown below:

Title page,
Item [56], References Cited, under U.S. PATENT DOCUMENTS, "6,077,937" should read -- 6,007,937 --.

Column 10,
Line 46, ":" should be deleted.

Column 13,
Lines 37-38, "including a housing" should be deleted.
Lines 60 and 64, -- target illuminator includes a -- should be inserted before "housing", and "contains" should be -- containing --.

Signed and Sealed this

Twenty-seventh Day of August, 2002

*Attest:*

*Attesting Officer*

JAMES E. ROGAN
*Director of the United States Patent and Trademark Office*